US011141760B2

(12) United States Patent
Naberg

(10) Patent No.: US 11,141,760 B2
(45) Date of Patent: Oct. 12, 2021

(54) SCREENING MACHINE FOR SCREENING MATERIAL ACCORDING TO SIZE

(71) Applicant: Finbawn LTD, County Donegal (IE)

(72) Inventor: Ralph Naberg, Grasse (FR)

(73) Assignee: Finbawn LTD, Co. Donegal (IE)

( * ) Notice: Subject to any disclaimer, the term of this patent is extended or adjusted under 35 U.S.C. 154(b) by 281 days.

(21) Appl. No.: 16/303,709

(22) PCT Filed: May 24, 2017

(86) PCT No.: PCT/EP2017/062571
§ 371 (c)(1),
(2) Date: Nov. 21, 2018

(87) PCT Pub. No.: WO2017/202929
PCT Pub. Date: Nov. 30, 2017

(65) Prior Publication Data

US 2020/0331029 A1 Oct. 22, 2020

(30) Foreign Application Priority Data

May 25, 2016 (EP) ..... 16171447

(51) Int. Cl.
*B07B 1/42* (2006.01)
*B07B 1/28* (2006.01)

(52) U.S. Cl.
CPC ..... *B07B 1/282* (2013.01); *B07B 1/284* (2013.01); *B07B 1/286* (2013.01); *B07B 1/42* (2013.01); *B07B 2201/04* (2013.01)

(58) Field of Classification Search
CPC ..... B07B 1/282; B07B 1/284; B07B 1/286; B07B 1/42
See application file for complete search history.

(56) References Cited

U.S. PATENT DOCUMENTS 3,630,357 A * 12/1971 Nolte ..... B07B 1/284 209/326
5,064,053 A * 11/1991 Baker ..... B65G 27/32 198/753

(Continued)

FOREIGN PATENT DOCUMENTS

CN 201431962 3/2010
EP 1 897 627 A2 3/2008

(Continued)

OTHER PUBLICATIONS

International Search Report and Written Opinion in International Application No. PCT/EP2017/062571 dated Oct. 24, 2017 (13 pages).

*Primary Examiner* — Patrick H Mackey
(74) *Attorney, Agent, or Firm* — Bookoff McAndrews, PLLC

(57) ABSTRACT

A circle throw screening machine for screening particulate material according to size is described. The machine comprises a housing (2) having a longitudinal aspect, an upper perforated deck (7), a frame (3) configured for mounting the housing, and a suspension system (4) for mounting the housing to the frame and configured to allow vibration of the housing relative to the frame. Three rotatable unbalanced drive shafts (5) are coupled to the housing (2) and configured to vibrate the housing in response to rotation of the drive shafts, wherein the three rotatable unbalanced drive shafts are equally spaced along the longitudinal aspect of the housing. A drive mechanism (6) is coupled to the unbalanced drive shafts (5) and configured to effect synchronous rotation of the three drive shafts in the same direction.

20 Claims, 3 Drawing Sheets

(56) References Cited

U.S. PATENT DOCUMENTS

| | | | | |
|---|---|---|---|---|
| 8,839,958 | B2 * | 9/2014 | Jonninen | B07B 1/4636 209/315 |
| 9,862,003 | B2 * | 1/2018 | Sauser | B07B 1/42 |
| 10,569,304 | B2 * | 2/2020 | Bellec | B65G 27/28 |
| 10,794,259 | B2 * | 10/2020 | Heeszel | F01P 5/06 |

FOREIGN PATENT DOCUMENTS

| | | | | |
|---|---|---|---|---|
| FR | 3006612 | A1 * | 12/2014 | B07B 1/44 |
| FR | 3006612 | A1 | 12/2014 | |

* cited by examiner

A
V
V

SCREENING MACHINE FOR SCREENING MATERIAL ACCORDING TO SIZE

TECHNICAL FIELD

The invention relates to a screening machine for screening material according to size. In particular, the invention relates to a screening machine for screening building materials such as gypsum, sand, gravel and very difficult to screen bulk materials. The invention also relates to a screening system comprising a screening machine, and a process for screening material that employs a screening machine of the invention.

BACKGROUND TO THE INVENTION

Vibrating deck screening machines, also known as particle projecting vibrating screens, are known and generally comprise a housing comprising at least one screen (deck) that is mounted to a frame by means of a suspension system that allow reciprocating movement of the housing relative to the frame, and a rotatable unbalanced shaft in contact with housing and configured to effect reciprocating vibrational movement of the housing (and deck) in response to rotation of the shaft. The reciprocating motion of the deck expands the material bed on the deck, individual particles are bounced along the deck causing the material to be sifted, and the strong normal force (due to a traditional acceleration of about 3.2 G force) acts to eject near-size particles stuck in the openings of the deck, thus resisting progressive blinding of the screen.

The background of the invention is to drive a vibrating screen at 2, then 3 times the traditional acceleration of 3.2 G force, it means at 6.4 G, then 9.7 G force. In one known screening machine, the rotatable unbalanced shaft is located towards a mid-point along the deck longitudinally, and in this configuration the reciprocating motion of the drive shaft at the mid-point of the deck causes the deck to bend and buckle towards the ends when higher G-forces (above 3.2 G) are applied to the particles on the deck. These problems can be overcome by making a screen and frame that can withstand the high G-forces being applied to the particles.

The object of the invention is the achievement to reach double or triple the traditional G force. To overcome the high energy into the screen body, we do overcome at least one of the above referenced problems.

FR3006612-A1 (FIG. 1) illustrates a vibrating device of the prior art. It is an inclined screen which includes a vibrating box suspended on a horizontal support frame, by means of springs disposed at the four corners of the box. The latter comprises 3 screening surfaces consisting of sieves, that is; panels with dots of mesh voids whose size of holes corresponds to the sorting size of the particulate material which is directed towards the box. To help the particulate material pass through the mesh and to circulate along the surface of the screen, a vibratory system is integrated in the screen box. The vibratory system is composed of three lines of unbalanced shafts arranged side by side and crossing transversely towards the centre of the deck. It is a vibratory system in which two unbalanced weights are rotated in opposite directions around individual shafts in order to obtain movements of agitation or oscillation of the box. A motor is provided for driving the shafts via drive means and universal joints and a mechanical or electronic synchronisation system for shafts is provided between the motor and the shafts. The three-shaft vibratory system imparts an elliptical motion to the box. The set of constraints related to the vibrations is concentrated in the vicinity of the transverse axis passing through the centre of gravity of the box. In order not to deform the structure of the casing and avoid any risk of premature failure of the motor and the synchronisation system, the vertical acceleration characterising the vibrations to the vicinity of 3G-5G.

EP1897627-A2 describes a screening machine comprising a semi-resonant vibrating double mass system consisting of two masses (heavy and light) configured for movement in opposite cyclic straight lines through axial mounted energy collecting coil springs. It is a linear motion single deck machine, as opposed to a circle throw machine. The double mass/coil spring system has to be tuned nearly above the resonance frequency to reach the expected screening amplitude, with the result that the amplitude and frequency of the screen can be tuned but not modified. The effective resulting vertical value Kv is about 9.5G, the linear motion results in severe wear of the screen meshes.

It is then an object of the invention to overcome at least one of the above-referenced problems, and provide a vibrating deck screening machine that can operate to subject particles on the deck to high G-forces without severe wear or bending or buckling of the screens or frame.

STATEMENTS OF INVENTION

The Applicant has discovered that the problems of the prior art can be solved by providing a vibrating deck circle throw screening machine having three rotatable unbalanced drive shafts, configured for synchronous rotation in the same direction, and that are spaced equally along the perforated deck of the screening machine. The term "equally spaced" is defined below, and means that the distance between a first end of the screen and the first drive shaft, the distance between the first and second drive shafts, the distance between the second and third drive shafts, and the distance between the third drive shaft and the second end of the deck, are substantially the same. Thus, the first, second and third drive shafts are positioned at about one quarter, one half and three quarters of the length of the deck in a longitudinal aspect. This configuration of rotatable drive shafts has been found to allow the machine to subject particles on the deck to very high G-forces compared to known machines, at or above 9.7 G, without bending or buckling and while using convention screens and frames. In addition, as a result of subjecting particles on the deck to such high G-force, a machine of the invention, with its 9.77 G acceleration, is capable of screening particulate material at the same rate as any other single shaft machine working at an acceleration of 3.2 G, while employing a screening area that is less than 60% the screening area of those any other single shaft machine (i.e. 60% more rate at the identical screening area than any other single shaft machine). In addition, the provision of three unbalanced drive shafts that rotate synchronously in the same direction and which are equally spaced along the deck, allows the machine to achieve such high G-forces without causing damage to the machine.

Referring to the prior art, neither FR3006612 nor EP1897627 employ three rotatable unbalanced drive shafts, configured for synchronous rotation in the same direction, and that are spaced equally along the perforated deck of the screening machine. In the machine of FIG. 1 of FR3006612, three unbalanced drive shafts are provided, but they are not equally spaced across the deck, and are therefore unable to subject particles on the deck to the high G-forces of the deck of the present invention.

In a first aspect, the invention provides a circle throw screening machine for screening particulate material according to size, the machine comprising:

- a housing having a longitudinal aspect, an upper perforated deck and optionally a lower deck disposed underneath the perforated upper deck;
- optionally, a frame configured for mounting the housing (optionally) in an inclined orientation;
- optionally, a suspension system for mounting the housing to the frame and configured to allow vibration of the housing relative to the frame in the inclined orientation;
- three rotatable unbalanced drive shafts coupled to the housing and configured to vibrate the housing in response to rotation of the drive shafts, wherein the three rotatable unbalanced drive shafts are equally spaced apart along the longitudinal aspect of the housing; and
- optionally, a drive mechanism coupled to the drive shafts and configured to effect synchronous rotation of the three drive shafts in the same direction.

In one embodiment, the drive mechanism comprises a single motor configured for synchronous rotation of the three drive shafts.

In one embodiment, the single motor is operatively coupled to a first of the drive shafts for rotation thereof.

In one embodiment, the drive mechanism comprises three external drive cardan shafts, each of which is coupled to an unbalanced drive shaft by a constant velocity joint. This serves to prevent vibration of the unbalanced drive shafts being passed to the external drive shafts (and to the drive mechanism). In one embodiment, a central external drive shaft is operatively connected to the motor by a drive belt. In one embodiment, the two other external drive shafts are operatively connected to the central external drive shafts by timing belts.

In one embodiment, the drive belts are tensioned typically by means of timing belts.

In another embodiment, the drive mechanism comprises a motor for each drive shaft, and a processor operatively coupled to each motor, wherein the processor is configured to control the motors to provide synchronous rotation of the three drive shafts.

In one embodiment, each drive shaft is mounted to the sidewalls of the housing in a manner that allows rotation of the shafts relative to the housing and translation of vibrational movement of the shaft to the housing. In one embodiment, each drive shaft is mounted to the housing substantially orthogonally to a longitudinal aspect of the housing. The drive shafts are parallel to each other.

In one embodiment, each of the rotatable unbalanced drive shafts comprises an unbalanced weight on each end that rotates with the drive shaft.

In one embodiment, an unbalanced weight is disposed on each end of each of the unbalanced drive shafts.

In one embodiment, the suspension system comprises a plurality of resiliently deformable members that couple the housing to the frame.

In one embodiment, the suspension system comprises at least four resiliently deformable members, two on each side of the housing.

In one embodiment, the resiliently deformable member is a helical spring (any type of isolator can be suitable such as Rostas, doesn't necessarily need to be springs all the time). They are typically configured to provide free reciprocating movement of the housing relative to the frame while maintaining the housing in the inclined orientation, i.e. enough movement to allow the housing vibrate in response to rotation of the unbalanced drive shafts.

In one embodiment, the housing is inclined, typically at a preferable angle of 10-16 degrees.

In one embodiment, the three unbalanced drive shafts extend laterally across the deck orthogonal and ideally perpendicular to the longitudinal aspect of the deck. In one embodiment, the three unbalanced drive shafts are substantially parallel to each other.

The invention also provides a process for screening a particulate material that employs a screening machine of the invention, the process comprising the steps of delivering material to be screened to a top end of the upper perforated deck, actuating the drive mechanism to effect synchronous rotation of the three unbalanced drive shafts and effect vibrational movement of the housing, whereby the vibrational movement of the housing moves of the material along the inclined upper perforated deck and simultaneously separates the material into a first fraction of material which is delivered to a lower deck and a second fraction of material that is delivered to a bottom end of the upper perforated deck.

In one embodiment, the drive mechanism is actuated to subject the particles of the material to a mechanical acceleration K of 9.7 G.

In one embodiment, the drive mechanism is actuated to effect synchronous rotation of the three drive shafts at a rotational speed sufficient to effect three rotations of each shaft per particle throw time.

In one embodiment, the particulate material is building material. In one embodiment, the particulate material is waste gypsum and any waste of all origins as well as dredging mud.

Definitions

"Circle throw screening machine" refers to machines having a one or more perforated deck mounted in a housing and having a vibration mechanism for vibration of the housing typically in a uniform circular movement. They are also known as "particle projecting vibrating machines". In one embodiment, the screening machine is inclined.

"Particulate material" means material that is very difficult or normally impossible to be screened. Specific materials include sand, gravel, stones, pebbles, mortar, hardcore crushed rock, broken bricks, blocks, gypsum boards, very sticky and/or fine mixtures of earth, clay, demolition materials and compost harbour dredging mud. In one embodiment, the particulate material has between 10 and 22% moisture. In one embodiment, the circle throw screening machine of the invention is capable of separating particulate material having an average particle size of less than 20 mm, or 10 mm. In one embodiment, the circle throw screening machine of the invention is capable of separating wet gypsum having an average particle size of less than 4 mm or 3 mm.

"Housing" refers to a frame or body for holding the decks—it is also sometimes referred to as a screenbody. Typically, it is an elongated housing with a rectangular cross-section, and the decks typically extend along most or all of the longitudinal aspect of the housing. Typically, the housing comprises opposed side panels. Generally, the housing comprises transverse supporting struts, and longitudinal supporting struts. In one embodiment, the housing is inclined.

"Longitudinal aspect" as applied to the housing means the direction in which the housing is inclined. Generally, the housing has a longitudinal aspect that is longer than a transverse aspect. Typically, the housing has a length that is at least two, three or four times greater than its width. Typically, the housing has a length of about 3-8 m, more preferably about 4-7 m, and ideally about 5-6 m. Typically, the housing has a width of 0.5-3.0 m, preferably about 1-2 m.

"Perforated" as applied to a deck means that the deck comprises holes which allow material of a certain defined size pass through. The term "mesh size" refers to the size of the holes. The mesh size can vary, for example from <2 mm for the MST model and from 2 mm to 50 mm for the SST model. Perforated decks for vibrational circle throw screening machines are known in the field, and are produced by suppliers such as GIRON, ISENMANN, GANTOIS, MINGRET, KRIEGER.

"Inclined orientation" means an angle of between 10 and 16 degrees with the horizontal. In one embodiment, the angle is between 12 and 16 degrees, ideally, the angle is about 14 degrees. (MST angle positions are between 8-14 degrees and the SST angle positions are between 12-16 degrees. It is the cutsize and the feed-rate which will determine the degree at which the machine will be inclined at).

"Suspension system" means a coupling system between the housing and frame that allows the housing vibrate in response to the rotation of the unbalanced drive shafts. Generally, the coupling system comprises a plurality of helical springs which isolates the embodiment from the frame.

"Vibration" means reciprocal movement, in our case the movement is circular (could be linear or elliptical) reciprocal movement in response to rotation of the unbalanced drive shafts.

"Unbalanced drive shaft" means a drive shaft having, a minimum of two unbalanced weights that rotate with the drive shaft and cause the rotating drive shaft to vibrate. The unbalanced drive shaft is operatively connected to the housing, for rotation relative to the housing, in such a way that the vibration of the shaft is translated into vibration of the housing.

"Equally spaced" means that the drive shafts are substantially equally spaced apart along the longitudinal aspect of the deck. Thus, for shafts A, B and C, the distance between a first end of the deck and shaft A is substantially equal to the distance between shafts A and B, and shafts B and C, and shaft C and the second end of the deck. (our solution to overcoming bending problems is the equally spaced drive shafts to distribute the vibration uniformly over the whole screen body, to overcome deformation of the screen body, which is due to high acceleration). Thus, adjacent shafts are distanced from each other by a distance of about one quarter of the length of the deck.

"Synchronous rotation" as applied to the drive shafts means that the speed of rotation of the three shafts does not differ (they operate synchronously with no difference—they are rotating equally.)

"Vertical G-force" or "KV": is the vertical acceleration the particle will obtain when it hits the screenmesh at the end of its projection. It is defined by the following equation:

$$Kv=K/\cos\beta,$$

where K is the mechanical acceleration of the machine and β is the slope of the machine in degrees. (K is measured in G; 981 $m/s^2$=1G)

DETAILED DESCRIPTION OF THE INVENTION

Figures 1A, 1B, 1C:
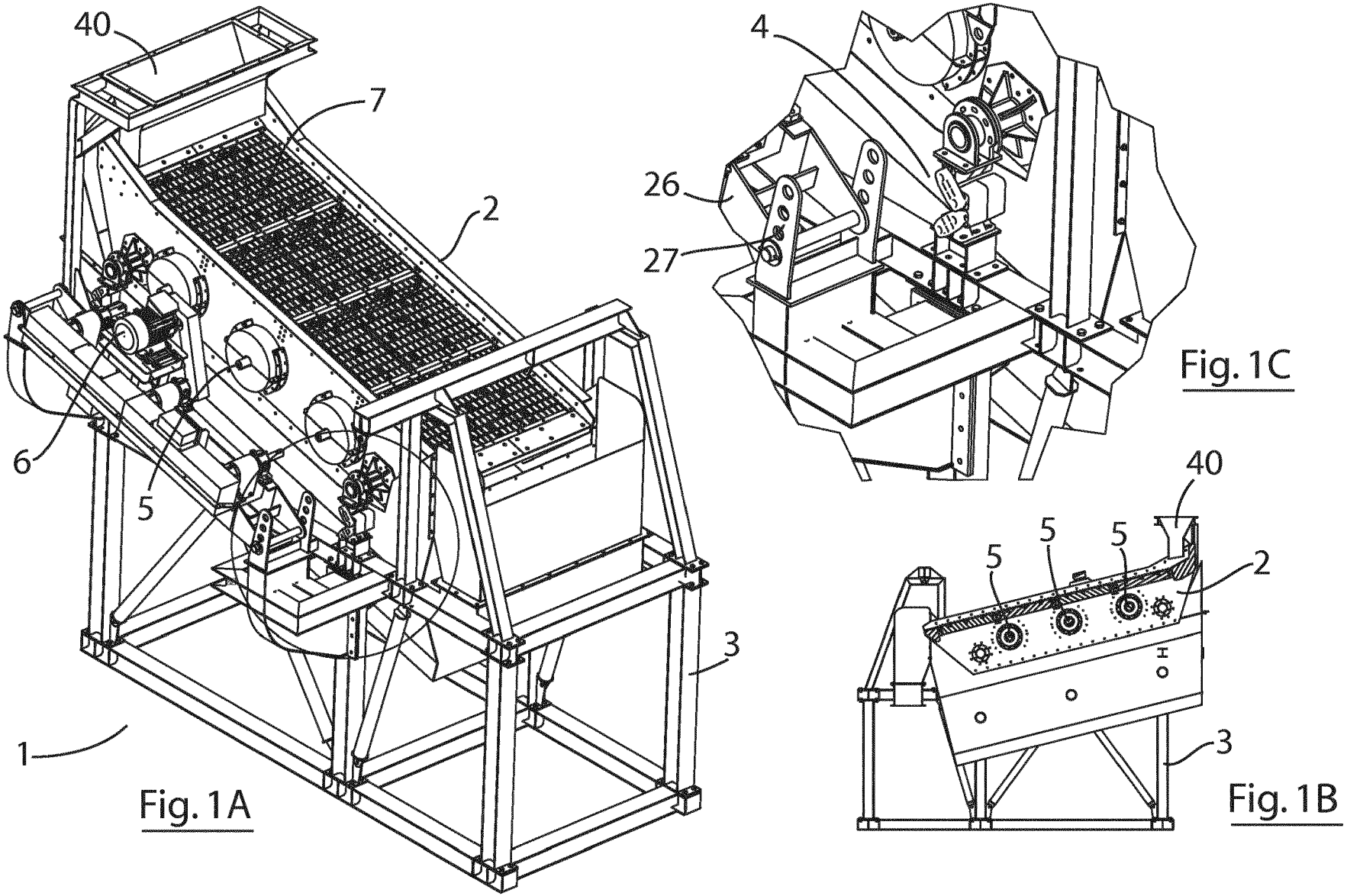
FIG. 1A is a perspective view of the MST circle throw screening machine of the invention; (As previously discussed
FIG. 1B is a side view of the circle throw screening machine of FIG. 1.
FIG. 1C is an exploded detailed view of part of the circle throw screening machine of FIG. 1A.

Referring to the drawings, and initially to FIG. 1, there is illustrated a circle throw screening machine of the invention indicated generally by the reference numeral 1. The machine illustrated is referred to as a MST circle throw screening machine and is used for fine, micron-sized, screening applications including defillerisation of sand and mud dewatering. The MST machine 1 comprises a housing 2, a frame 3, a Rosta suspension system 4 (FIG. 1*c*) coupling the housing 2 to the frame 3, three rotatable unbalanced drive shafts 5, and a drive mechanism 6 for driving the drive shafts 5. The frame 3 is configured to position the housing 2 in an inclined orientation, inclined at 8-14 degrees to the horizontal, although inclined mounting is not essential. The housing has an upper deck 7 comprising four perforated screen sections which abut end-to-end to form a screening deck bolted on to the support frame and having a screening length of 4 m and a screening aperture between 0.075 mm and 0.1 mm. The drive shafts 5 are disposed beneath, and equally spaced along, the deck 7.

Referring specifically to FIG. 1C, the degree of inclination of the housing with respect to the frame can be adjusted between 8, 10, 12 and 14 degrees by moving the position of the handle 26 in the slotted bracket 27.

In more detail, and referring to FIGS. 2 to 7, the circle throw screening machine of the invention will be described in more detail with reference to a second embodiment of the machine referred to as a SST circle throw screening machine. This machine is substantially similar to the MST machine described with reference to FIG. 1 with the exception that the upper deck 7 is formed from five sections which abut end-to-end to form a screening deck 5.6 m in length and having a screening aperture between 2 mm and 50 mm, and the SST machine has a lower deck 8 disposed beneath the three drive shafts 5. The SST machine is used for coarse screening applications including gypsum, rocks, stones, harbour mud and the like.

Referring to FIGS. 2 to 6, the housing 2 is coupled to the frame 3 by helical springs 12 (which comprise the suspension system) disposed at the foot of pillars 11 on each side of the housing. The purpose of the springs is to allow the housing to vibrate relative to the frame during rotation of the unbalanced drive shafts.

The housing 2 has opposed side walls 10, between the pillars and springs on both sides is a double plate on each side which is 6 mm thicker than the rest of the machine sidewall width of 8 mm, with the pillars 11 mounted to the side walls 10. The upper deck 7 comprises five cross-struts 14 mounted between the side walls and in addition three longitudinal struts 15 mounted to each end of the housing (the screens are removed for illustration purposes). The lower deck 8 comprises six cross-struts 16 mounted between the side walls and three longitudinal struts 17 mounted to each end of the housing (the screens are removed for illustration purposes).

Figures 2, 3, 4, 5, 6, 7:
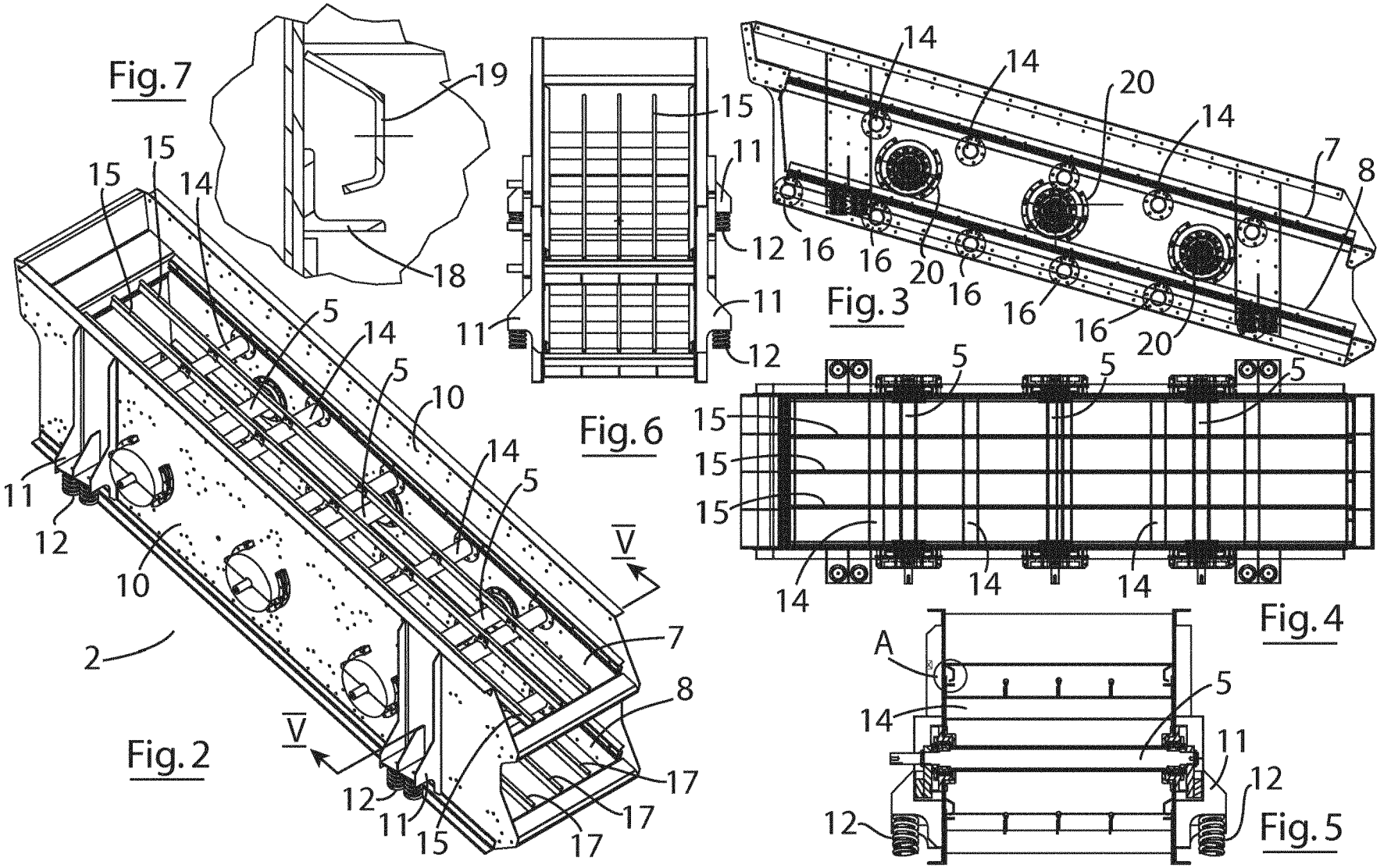
FIG. 2 is a perspective view of the housing forming part of an SST screening machine of the invention shown without the upper and lower perforated screens to illustrate the internal configuration of the housing.
FIG. 3 is a side elevational view of the housing of FIG. 2.
FIG. 4 is a top plan view of the housing of FIG. 2.
FIG. 5 is a sectional view through the housing taken along the lines V-V of FIG. 2.
FIG. 6 is a top view of the elevational side view of FIG. 3.
FIG. 7 is a detail of from FIG. 5 showing a support system for the upper and lower perforated deck.

Referring specifically to FIGS. 2 and 4, each unbalanced drive shaft 5 is mounted between the side walls 10 for rotation relative to the housing. Spherical roller bearings (not shown) designed for supporting an oscillating load are provided to carry the drive shafts and translate vibration of the shaft into vibration of the housing. An unbalanced weight 20 is provided at each end of the drive shafts 5, external to the side walls of the housing, for rotation with the drive shaft. As is evident from FIG. 2, the unbalanced drive shafts run substantially orthogonal to the longitudinal aspect of the housing, and are equally spaced along and below the deck 7 in the MST machine, and along and between the decks 7 and 8 in the SST machine). During use, rotation of the shafts and unbalanced weights cause the shafts to vibrate, and the vibration is passed to the housing which in turn causes the upper deck to vibrate and effect a screening action on particulate material disposed on the upper deck 7 in the MST machine and on both decks 7, 8 in the SST machine.

The housing 2 includes a cross-tensioning support system for the upper deck 7 (on SST only) which is indicated by the reference numeral A in FIG. 5 and shown in an exploded view in FIG. 7. The support system comprises an elongated L-shaped corner support 18 mounted on each sidewall of the housing, and formed in five sections corresponding to the five sections of the upper deck, and an elongated tensioning plate 19 mounted on each sidewall of the housing above the corner support 18. The upper screen sections are mounted to the housing, and tensioned, between the corner supports 18 and tensioning plates 19.

Figure 8:
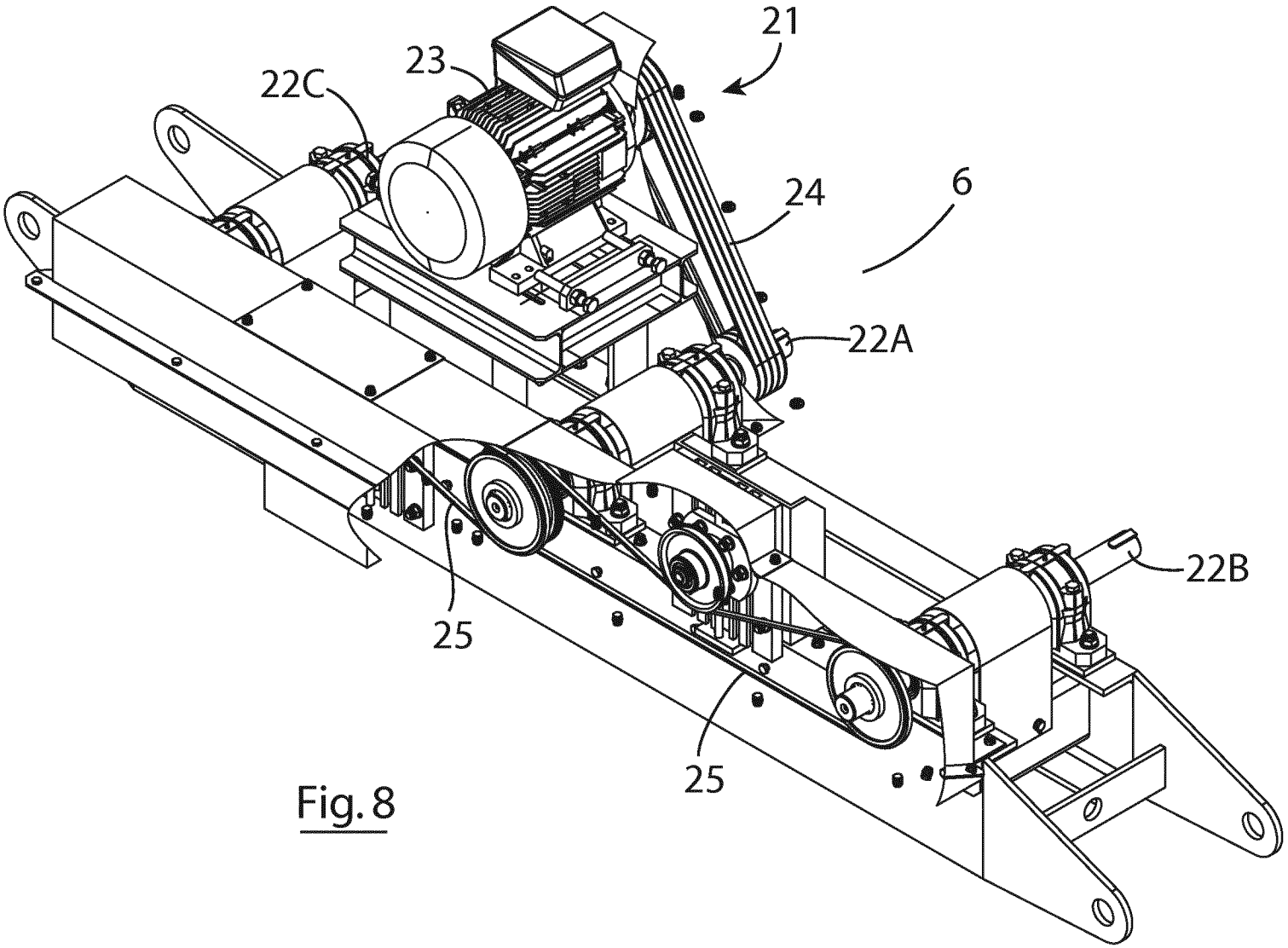
FIG. 8 is a perspective view of a drive mechanism for the three rotatable unbalanced drive shafts forming part of the MST and SST circle throw screening machines of the invention.

Referring now to FIG. 8, the drive mechanism 6 for both the MST and SST machines is illustrated and comprises a motor 23 having a motor drive shaft 21, three external drive shafts namely a central external drive shaft 22A, and side external drive shafts 22B and 22C. Each of the external drive shafts 22A, 22B and 22C are coupled to the unbalanced drive shafts of the housing by CV joints (not shown). The motor drive shaft 21 is operatively coupled to the central external drive shaft 22A by a drive belt 24, and the side external drive shafts 22B, 22C are coupled to the central external drive shaft 22A by timing belts 25. This arrangement provides for the three unbalanced shafts of the housing being driven by a single variable speed motor and rotating in the same direction of rotation and at the same speed, and obviated the need for multiple motors and motor-speed synchronisation software.

In use, the motor is started causing the three unbalanced drive shafts to rotate which in turn causes the upper deck to vibrate. Particulate material is delivered to the uppermost end of the upper deck, typically by means of an inlet hopper (see inlet hopper 40 in FIG. 1A). Upon delivery to the deck, the vibration of the deck causes the particles on the deck to lift-off with a vertical acceleration Kv and then land back on the deck with an impact that causes the particles to pass through the perforated deck. With the machine of the present invention, the rotational speed of the unbalanced shafts can be set such that the mechanical acceleration of the screen particles is 9.7 G, without causing the deck to buckle or break. The particles which pass through the upper perforated screen pass on to the lower (non-perforated) deck, which also vibrates, causing the particles to move along the deck to a lower end of the deck where they pass on to a conveyor for storage or for further processing. The particulate material which remains on the upper deck is moved towards the lower end of the deck by the incline and vibration, where it is delivered to an adjacent conveyor for further processing or re-circulation through the screening machine for further screening. In this embodiment, the machine screens particulate material to provide two fractions, a coarse fraction which remains on the upper deck and a less coarse fraction that passes through the upper deck on to the lower deck.

The embodiment of the machine described above has a non-perforated lower deck, which collects the finer fraction of particulate material and passes to a collection hopper or conveyor (or the like). In this embodiment, the screening machine produces three fractions of material, a coarse fraction which remains on the upper deck, a less coarse fraction which remains on the (lower) deck. When referring to the SST it has 3 fractions as mentioned. The MST has only 2 fractions material; the top deck (overs) and the material which falls through this onto the conveyor (fines).

The embodiment of the machine of the invention described above is fitted with a cross tension system, slightly arched over bucker-up strips and tightened on both sides (SST only). However, in another embodiment, the machine is fitted with flat rectangular prefabricated screening panels, bolted straight on to the support frame (MST only). Both systems are very coarse and are capable of resisting a G-force (approaching) 100 on the machine.

The invention is not limited to the embodiment hereinbefore described which may be varied in construction and details without departing from the spirit of the invention.

The invention claimed is:

1. A circle throw screening machine for screening particulate material according to size, the machine comprising:

a housing (2) having a longitudinal aspect, an upper perforated deck (7) and a lower deck disposed underneath the perforated upper deck;

a frame (3) for mounting the housing;

a suspension system (4) for mounting the housing to the frame to allow isolation of the housing relative to the frame;

three rotatable unbalanced drive shafts (5) coupled to the housing (2) to vibrate the housing in response to rotation of the drive shafts; and a drive mechanism (6) coupled to the unbalanced drive shafts (5) to effect synchronous rotation of the three drive shafts in the same direction;

wherein the three rotatable unbalanced drive shafts are equally spaced along a longitudinal aspect of the upper perforated deck (7) and the distance between a first end of the upper perforated deck (7) and the first drive shaft, the distance between the first and second drive shafts, the distance between the second and third drive shafts, and the distance between the third drive shaft and a second end of the deck (7), are substantially the same.

2. A circle throw screening machine according to claim 1 in which the drive mechanism subjects the particles to a G-force at or above 9.7G.

3. A circle throw screening machine according to claim 1 in which the drive mechanism is actuated to effect synchronous rotation of the three drive shafts at a rotational speed sufficient to effect three rotations of each shaft per particle throw time.

4. A circle throw screening machine according to claim 1 in which the drive mechanism (6) comprises a single motor (23) for synchronous rotation of the three drive shafts.

5. A circle throw screening machine according to claim 1 in which the drive mechanism (6) comprises a single motor (23) for synchronous rotation of the three drive shafts, wherein the single motor (23) is operatively coupled to a first of the drive shafts for rotation thereof.

6. A circle throw screening machine according to claim 1 wherein the drive mechanism (6) comprises three external drive shafts (22), each of which is coupled to an unbalanced drive shaft (5).

7. A circle throw screening machine according to claim 1 wherein the drive mechanism (6) comprises three external drive shafts (22), each of which is coupled to an unbalanced drive shaft, and in which the external drive shafts (22) include a central external drive shaft (22A) and two side external drive shafts (22B, 22C), wherein the central external drive shaft is operatively connected to the motor (23) by a drive belt (24) and each of the side external drive shafts are operatively connected to the central external drive shafts by a timing belt (25).

8. A circle throw screening machine according to claim 1 in which each drive shaft is mounted to the sidewalls (10) of the housing (2) in a manner that allows rotation of the unbalanced drive shafts (5) relative to the housing and translation of vibrational movement of the shafts (5) to the housing.

9. A circle throw screening machine according to claim 1 in which an unbalanced weight (20) is disposed on each end of each of the unbalanced drive shafts (5).

10. A circle throw screening machine according to claim 1 including a plurality of lower decks including at least one perforated lower deck (8).

11. A circle throw screening machine according to claim 1, in which the three unbalanced drive shafts extend laterally across the deck orthogonal to the longitudinal aspect of the deck.

12. A circle throw screening machine according to claim 1, in which the drive shafts (5) are parallel to each other and orthogonal to the longitudinal aspect of the housing.

13. A circle throw screening machine according to claim 1, in which the upper perforated deck (7) has a mesh size of between 0.025 mm and 1 mm.

14. A circle throw screening machine according to claim 1, in which the upper perforated deck (7) has a mesh size of between 2 mm and 50 mm.

15. A circle throw screening machine for screening particulate material according to size, the machine comprising:

a housing (2) having a longitudinal aspect, an upper perforated deck (7) and a lower deck disposed underneath the perforated upper deck;

a frame (3) for mounting the housing;

a suspension system (4) for mounting the housing to the frame to allow isolation of the housing relative to the frame;

three rotatable unbalanced drive shafts (5) coupled to the housing (2) to vibrate the housing in response to rotation of the drive shafts; and a drive mechanism (6) coupled to the unbalanced drive shafts (5) to effect synchronous rotation of the three drive shafts in the same direction;

wherein the three rotatable unbalanced drive shafts are equally spaced along a longitudinal aspect of the upper perforated deck (7), wherein the drive mechanism (6) comprises three external drive shafts (22), each of which is coupled to an unbalanced drive shaft, and in which the external drive shafts (22) include a central external drive shaft (22A) and two side external drive shafts (22B, 22C), wherein the central external drive shaft is operatively connected to the motor (23) by a drive belt (24) and each of the side external drive shafts are operatively connected to the central external drive shafts by a timing belt (25).

16. A circle throw screening machine according to claim 15 in which the drive mechanism subjects the particles to a G-force at or above 9.7G.

17. A circle throw screening machine according to claim 15 in which the drive mechanism is actuated to effect synchronous rotation of the three drive shafts at a rotational speed sufficient to effect three rotations of each shaft per particle throw time.

18. A circle throw screening machine for screening particulate material according to size, the machine comprising:

a housing (2) having a longitudinal aspect, an upper perforated deck (7) and a lower deck disposed underneath the perforated upper deck;

a frame (3) for mounting the housing;

a suspension system (4) for mounting the housing to the frame to allow isolation of the housing relative to the frame;

three rotatable unbalanced drive shafts (5) coupled to the housing (2) to vibrate the housing in response to rotation of the drive shafts; and a drive mechanism (6) coupled to the unbalanced drive shafts (5) to effect synchronous rotation of the three drive shafts in the same direction;

wherein the three rotatable unbalanced drive shafts are equally spaced along a longitudinal aspect of the upper perforated deck (7) and the distance between a first end of the upper perforated deck (7) and the first drive shaft, and the distance between the first and second drive shafts, are substantially the same.

19. A circle throw screening machine according to claim 18 in which the drive mechanism subjects the particles to a G-force at or above 9.7G.

20. A circle throw screening machine according to claim 18 in which the drive mechanism is actuated to effect synchronous rotation of the three drive shafts at a rotational speed sufficient to effect three rotations of each shaft per particle throw time.

* * * * *